US005587185A

United States Patent [19]

Schmidgall et al.

[11] Patent Number: 5,587,185

[45] Date of Patent: Dec. 24, 1996

[54] AUTOMATED SYSTEM FOR HANDLING AND CLEANING CONCRETE PIPE-MAKING COMPONENTS

[75] Inventors: Hartzell H. Schmidgall; Jon A. Schmidgall, both of Mediapolis, Iowa

[73] Assignee: Hawkeye Concrete Products Co., Mediapolis, Iowa

[21] Appl. No.: 229,191

[22] Filed: Apr. 18, 1994

[51] Int. Cl.[6] ..... A46B 13/02

[52] U.S. Cl. ..... 425/229; 15/88.3; 15/93.4; 425/231; 451/258

[58] Field of Search ..... 425/225, 229, 425/231; 15/77, 88.1, 88.2, 88.3, 88.4, 93.1, 93.4; 451/258

[56] References Cited

U.S. PATENT DOCUMENTS

| | | | |
|---|---|---|---|
| 3,797,058 | 3/1974 | Neal | 15/88.3 |
| 3,849,820 | 11/1974 | Lang | 15/88.3 |
| 4,009,499 | 3/1977 | Casler et al. | 15/88.3 |
| 4,532,665 | 8/1985 | Evans et al. | 15/88.3 |

OTHER PUBLICATIONS

Pfeiffer Pallet Handling System Sales brochure.

*Primary Examiner*—James P. Mackey
*Attorney, Agent, or Firm*—James C. Nemmers

[57] ABSTRACT

An automated system for handling concrete pipe and for handling and cleaning the components used in the manufacture of the pipe. Once concrete pipe has cured, the system automatically removes the bell and spigot forming rings from the pipe, and cleans and oils them for reuse. At the ring removal station, the pipe is properly positioned and oriented and the rings are pulled from each end of the pipe and transported to cleaning and oiling stations where all critical surfaces of the rings are cleaned by pulverizing, chiseling and brushing the concrete residue from the rings which are then coated with oil. The automated system is designed to handle rings of different sizes without any intervention by an operator, and the system will handle rings of different diameters that are intermixed.

6 Claims, 7 Drawing Sheets

FIG. 9
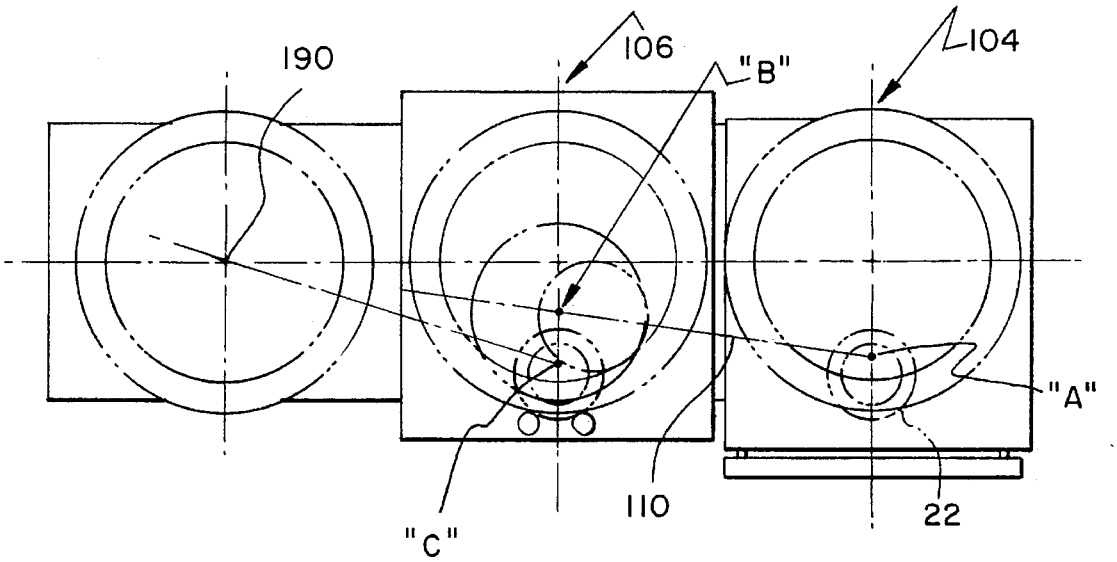
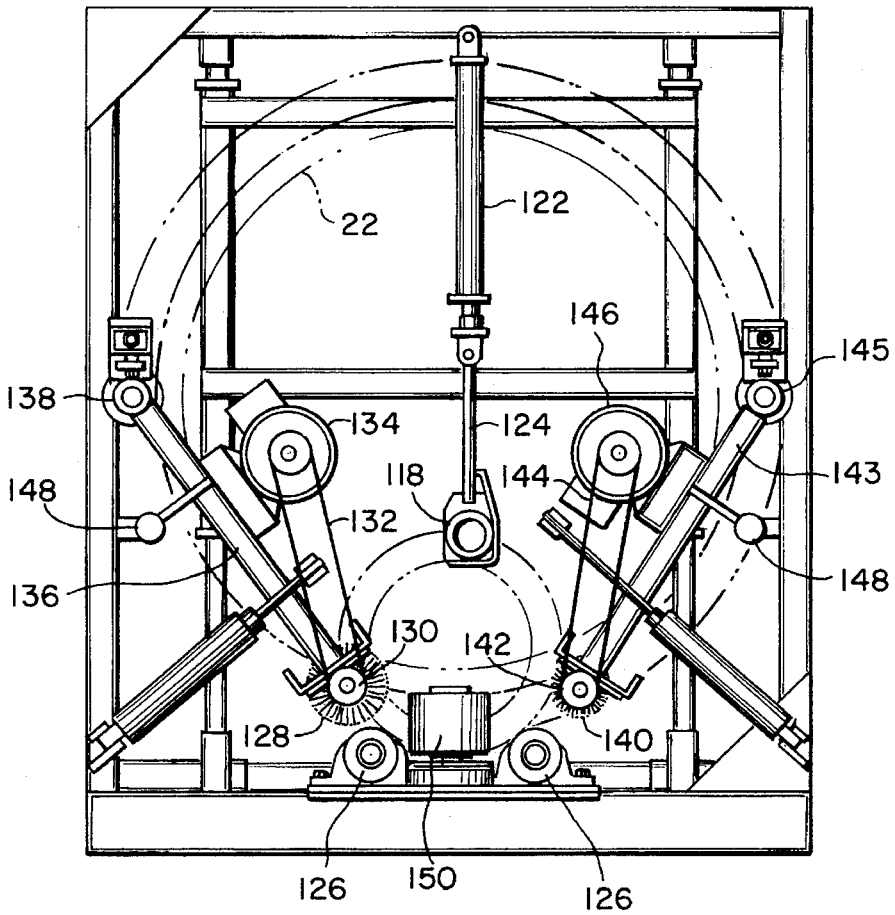
FIG. 10

AUTOMATED SYSTEM FOR HANDLING AND CLEANING CONCRETE PIPE-MAKING COMPONENTS

BACKGROUND OF THE INVENTION

This invention relates to machines for producing concrete products such as concrete pipe, manholes, catch basins, and the like. The machines used to produce pipe employ the three basic steps of filling the forms, pressureheading concrete in the forms, and then stripping the forms from the pipe and allowing the pipe to cure. During the manufacturing process, a bell forming ring, commonly called a pallet, is placed at the bottom of the core and jacket to form one end of the pipe and support it during curing. After the form is filled with concrete, and during the pressureheading step, a spigot forming ring, called a header, is pressed into the wet concrete at the end of the pipe opposite the pallet ring to form the other end of the pipe. This header ring also is left in place during the curing of the concrete. Examples of concrete pipe-making machines are illustrated in Schmidgall U.S. Pat. No. 4,708,621 and Schmidgall U.S. Pat. No. 5,234,331.

After the concrete pipes have cured, the pallet and header rings must be removed. Also, since these rings are large metal rings and relatively expensive, they are reused, and the surfaces must be cleaned to remove all concrete residue and the rings oiled before reuse. Since several of the inside surfaces of these rings form the ends of the pipe that form the pipe joints when the pipes are installed, proper cleaning of the surfaces of the rings is important to production of high quality pipe. Moreover, if the outside surfaces are also not properly cleaned, a build up of dried concrete can prevent proper positioning and alignment of the rings when they are reused and set in place with the jacket and core to produce another pipe. In some instances, if the concrete is not removed, the build up can be so severe that the rings will jam and cause considerable problems during the stripping of the forms.

At the present time, it is common practice to remove, clean and oil the pallet and header rings manually, and if the worker is not careful, damage can be done to the pipe and the rings. More importantly, performing these tasks manually is a difficult, unpleasant and sometimes dangerous job. The ring is manually removed by hammering on the ring, and cleaning is commonly done by a worker using a power operated brush to remove the concrete build up. All of these tasks involve the use of heavy hand and power tools and repetitive movements, such as bending, lifting, etc. that can lead to work related physical and mental conditions. Anticipated governmental regulations may require new methods and systems that provide cumulative trauma disorder protection of all workers by imposing ergonomic standards on pipe manufacturers. One prior art system attempts to overcome the problems associated with and resulting from these manual tasks by automating the ring removal and cleaning operations in which the cured pipe is oriented vertically and one ring at a time is pulled from each end of the pipe. The rings are then placed on two turn tables, and a ring is cleaned by brushing on one turn table, and when the ring has been cleaned, the second turn table is automatically pivoted to place the second ring in position for cleaning while the now-brushed ring is automatically removed and a second ring is placed on that turn table. The process then repeats itself, and use of the two turn tables allows a cleaned ring to be removed and a dirty ring to be placed on one turn table while one ring is being cleaned on the other turn table. This prior art system is relatively slow and is complex and expensive. Moreover, the system uses only brushes, and not infrequently, the brushes are incapable of removing some of the concrete build up. When this occurs, that build up must be manually removed. Moreover, the prior art systems are limited to handling rings of a single diameter at a time. To accommodate rings of a different diameter or of a different type (i.e. headers or pallets) the set up must be changed during which time the cleaning operation is shut down. This is a distinct disadvantage, especially since concrete pipe manufacturers frequently produce pipes of different sizes during a single operation. Equipment for accomplishing this is illustrated in Schmidgall U.S. Pat. No. 4,708,621. Therefore, in a plant operation which is producing different pipe sizes during a single cycle of operation, the rings must be sorted and grouped by size and cleaned by size in order to minimize the cleaning set up time.

It is highly desirable in pipe-making operations to be able to quickly and efficiently perform all the cleaning functions. In fact, overall plant production can in many cases depend upon the ability to quickly remove and clean the rings from the pipe for reuse.

There is therefore a need for an improved method and system for removing the rings from the cured pipe in a safe, rapid and efficient manner while minimizing any damage to the pipe.

There is a further need for an improved method and system for cleaning the pallet and header rings for reuse, including a system that will also remove the concrete build up that brushes of the prior art systems cannot presently remove.

The methods and systems of the invention will fulfill these and other needs by providing a fully automated system for removing the rings and cleaning and oiling them without the intervention of an operator. By eliminating the manual labor presently required, worker physical and mental health and safety will be improved. The invention also will provide an automated system that will meet the anticipated standards relating to cumulative trauma disorder prevention. Moreover, the methods and systems of the invention will be environmentally sound, since escape of dust and oil fumes into the environment will be controlled.

The advantages and features of the methods and systems of the invention will become more evident from the detailed description of the preferred embodiments set forth hereinafter.

SUMMARY OF THE INVENTION

The methods and systems of the invention provide a pipe loading station in which the pipe are automatically fed into an alignment station where each pipe is laterally aligned after which each pipe is moved into a rotational alignment station and the pipe is rotated so that it is properly aligned for removal of the rings. The pipe then proceed to a station in which both the header and pallet rings are simultaneously pulled from the pipe. Following removal of the rings, the pipe proceed to various other stations for the performing of one or more required or desired operations such as honing, hydrostatic testing, deburring and inspection, after which the pipe are finally moved to an unloading station. In the meantime, the header rings are passed into a cleaner and oiler while the pallets are likewise passed into a cleaning and oiling station. At the cleaning and oiling stations, each ring is pulled into a protected area that is enclosed with a sealed hood so that dust from cleaning and fumes and spray from oiling can be properly controlled to protect the environment. In the cleaning area, the rings are positioned and rotated while pulverizers, vibrating chisels and brushes clean all of the critical surfaces of the header or the pallet ring. The now cleaned ring is then pulled from the cleaning station and into and through an oiling station while simultaneously the next ring is advanced into the cleaning station. The system of the invention includes a "shark fin" device that moves the rings into and out of the cleaning and oiling chambers, and a unique arrangement that allows the handling of rings of different sizes, positions the rings against the power drive rollers, which pulverize the concrete residue on some of the critical surfaces, after which vibrating chisels and brushes are moved into position to complete the cleaning operation.

BRIEF DESCRIPTION OF THE DRAWING

FIG. 9 is a plan view showing schematically the manner in which rings of different sizes and diameters are moved into and positioned in the cleaning and oiling stations;

FIG. 10 is a top or plan view of the cleaning station for pallet rings and illustrating the ring positioning mechanism and the brushes necessary for cleaning pallet rings;

FIG. 15 is a schematic showing and illustrating the device for moving the rings into and out of the cleaning and oiling stations;

DESCRIPTION OF THE PREFERRED EMBODIMENTS OF THE INVENTION

Figure 1:
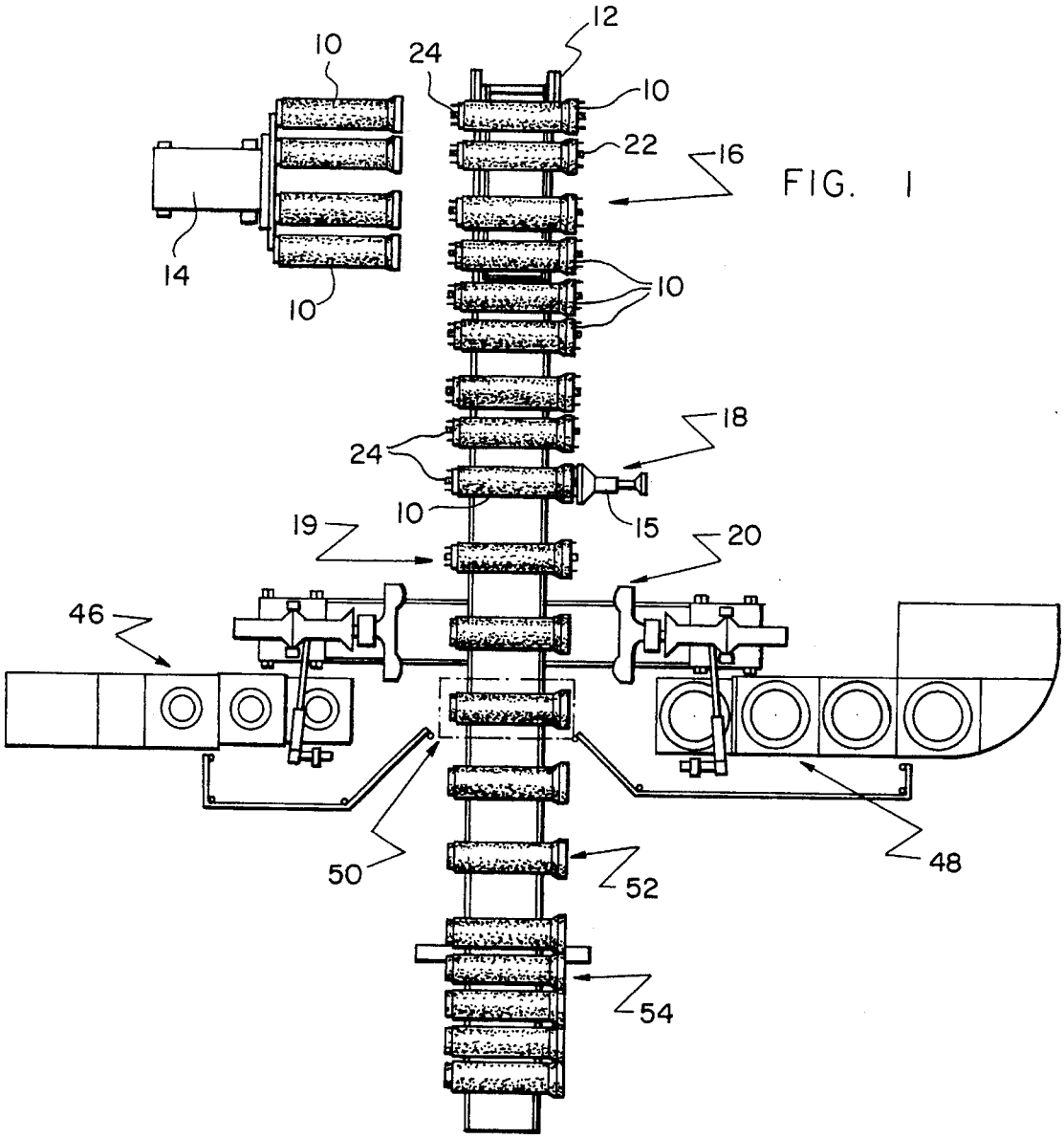
FIG. 1 is a top view showing a layout of the system of the invention for removing the rings and cleaning and oiling them.

Referring first to FIG. 1, there is shown a plan view which illustrates a layout that employs the methods and systems of the invention. The individual concrete pipe 10 are loaded on to a conveyor 12 in any suitable manner such as by a forklift 14. Once placed on the conveyor 12 at a loading station 16, the pipe 10 are advanced to an alignment station 18 where the pipe 10 are laterally aligned by a positioning head 15 so that their ends are properly positioned for advancement in the subsequent stations. At the next station, the rotational alignment station 19, each pipe 10 is individually rotated in any suitable manner for proper positioning of the lugs on a header ring, for example, in the ring removal station 20. As is well known to those skilled in the art, each pipe 10 has a bell-forming ring 22, called a pallet, at one end and a spigot-forming ring 24, called a header, at the opposite end. For purposes of simplicity, the word "ring" is used hereinafter to refer to either a bell-forming ring 22 or a spigot-forming ring 24, and a bell-forming ring 22 is simply referred to as a "pallet" 22 and a spigot-forming ring 24 is simply referred to as a "header" 24.

Figure 2:
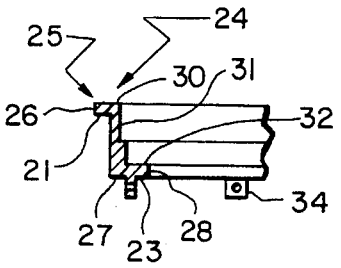
FIG. 2 is a sectional view illustrating one common type of header ring to which the principles of the invention are applicable.
Figure 3:
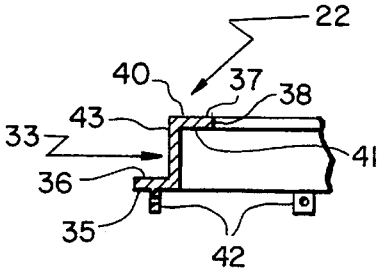
FIG. 3 is a sectional view of a portion of a typical pallet ring.

FIGS. 2 and 3 show a cross-sectional shape of a portion of a header 24 (FIG. 2) and a pallet 22 (FIG. 3). Referring first to FIG. 2, the header 24 has an upper flange 25 having an outer edge 26 and a bottom surface 21. The header 24 also has a bottom flange 27 having an inner edge 28 and a bottom surface 23. The upper flange 25 of header 24 also has a top surface 30 and there is an inner surface 32 on the bottom flange 27. In addition, the header 24 has an inside circumferential surface 31, and is provided with lugs 34 which are spaced around the bottom flange 27, which lugs are used in the pressurizing cycle during the manufacture of the pipe.

FIG. 3 illustrates a pallet 22 which has a bottom flange 35 having a top surface 36 and an upper flange 37 which has an inner edge 38, a top surface 40 and an inner surface 41. A vertical flange 33 connects the bottom flange 35 and the upper flange 37, and vertical flange 33 has an outer surface 43. Lugs 42 extend downwardly from the bottom flange 35.

At the lateral alignment station 18, a positioning head 15 will move each pipe 10 laterally so that the rings 22 and 24 at the ends of each pipe 10 will be properly aligned when the pipe reaches ring removal station 20. If the pipe 10 must also be radially aligned so that the lugs 34 of the header 24, for example, are properly positioned for gripping at the ring removal station 20, the rotational or radial alignment station 19 will rotate the pipe. For example, each pipe 10 can rest in a cradle (not shown) on the conveyor 12 which cradle consists of a pair of wheels beneath the pipe 10 at each end. A hydraulic motor (not shown) drives the wheels to rotate the pipe 10 until a sensor (not shown) senses that the lugs 34 of the header 24 are properly positioned for gripping at the ring removal station 20 in the manner described hereinafter. The sensor can be of any suitable type, mechanical or electronic, that can sense the rotational position of the lugs 34 of the header 24. The gripping mechanism at the ring removal station is more fully illustrated in FIGS. 4 and 5 and will be described hereinafter. After leaving the ring removal station 20, the individual headers 24 are moved into the header cleaning and oiling station 46 while the pallets 22 are moved into the pallet cleaning and oiling station 48. The individual pipes 10 with the rings now removed continue down the conveyor where additional operations can be performed as desired. For example, the pipe can be deburred at a deburring station 50, visually inspected at an inspection station 52, hydrostatically tested and then moved into an unloading station 54 for removal to storage. It should be understood that the particular operations performed will depend upon the needs and desires of the particular pipe manufacturer.

Figures 4, 5:
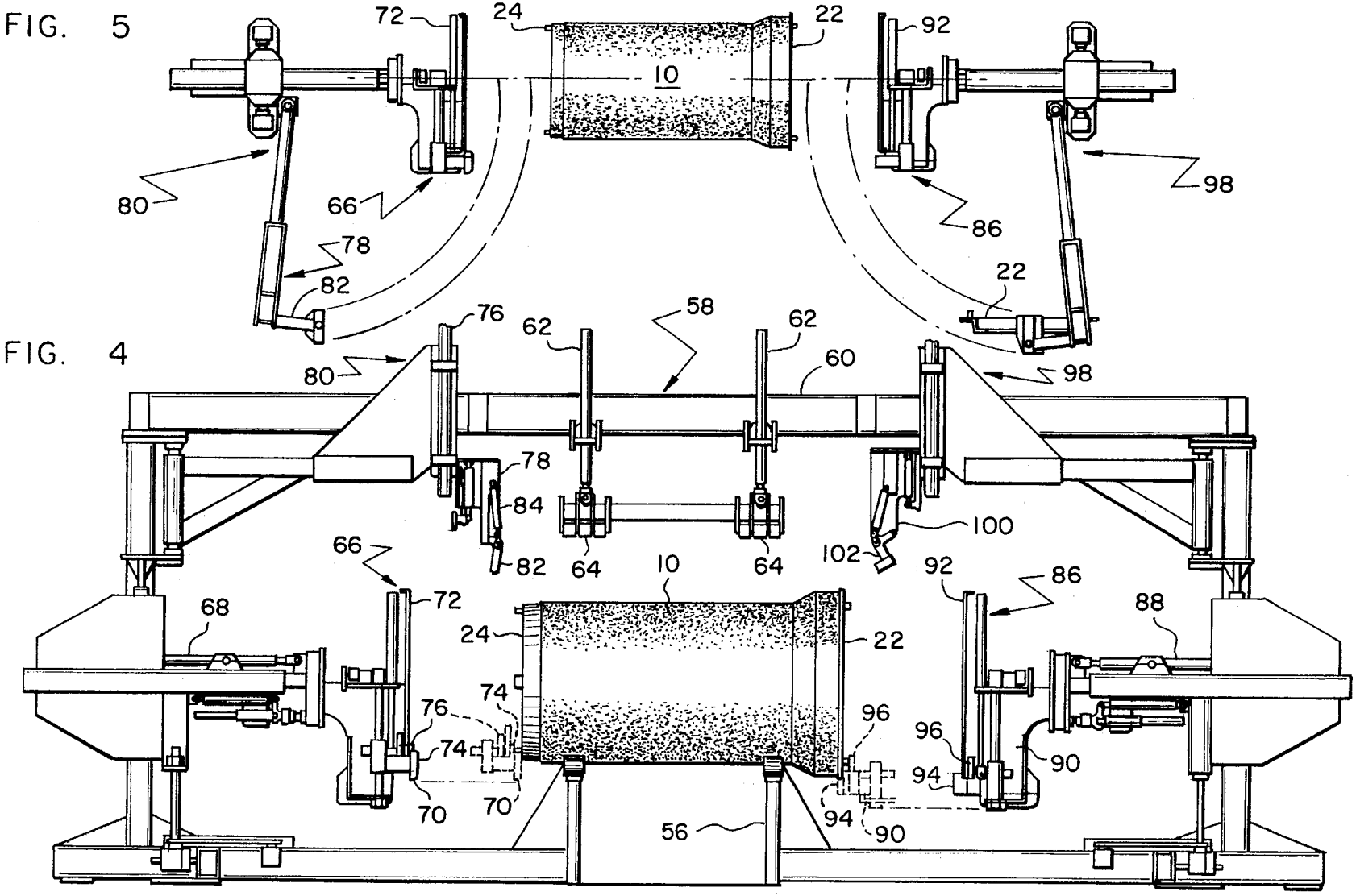
FIG. 4 is an elevational view of the ring pulling station.
FIG. 5 is a top or plan view of the ring pulling station.

Referring now to FIGS. 4 and 5, there is illustrated a system for removing the rings at the ring removal station 20. At the ring removal station 20, the conveyor 12 places the pipe in a cradle 56, and then a pipe clamp 58 is lowered from an overhead support structure 60 by any suitable means such as hydraulic cylinders 62. The pipe clamp 58 has a pair of hands 64 that are preferably curved to the contour of the pipe. The pipe clamp 58 holds the pipe in the cradle 56.

Figure 6:
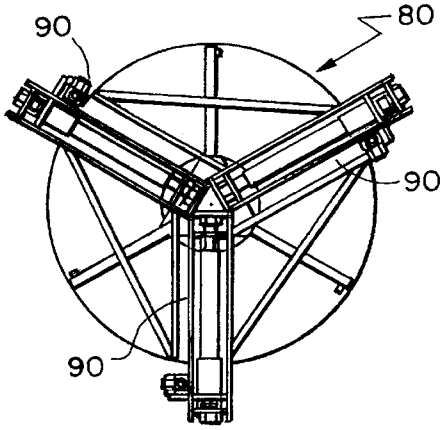
FIG. 6 is an end elevational view of the pallet puller at the pulling station.

While the pipe 10 is being held in the cradle 56, a header gripper 66 is advanced toward the header 24 by hydraulic cylinder 68. The header gripper 66 contains three legs 70 which are evenly spaced about the puller 72. In FIG. 4, only one leg 70 is shown for purposes of clarity, but FIG. 6 illustrates the location of the legs on the pallet gripper 86 which will be described hereinafter. The spacing and operation of the legs 70 on the header gripper 66 are substantially similar to that shown in FIG. 6.

Because the headers 24 contain lugs 34 that have openings in them (see FIG. 2), leg 70 contains a lug hook 74 which will move inwardly into the opening in a lug 34 of a header 24. With three lugs 34 thus hooked by lug hook 74, cylinder 68 will pull the header gripper 66 to apply pressure to the lugs 34, and then air hammers 76, which form a part of the header gripper 66, will tap the header 24 to gently loosen the header 24 from the pipe 10 while the header gripper 66 continue to be retracted by action of the cylinder 68 until the header 24 is pulled free from the pipe 10.

When the header 24 is free from the pipe 10, a header jib clamp 78 is lowered from the header jib 80 which is mounted on the supporting structure 60 as shown in FIGS. 4 and 5. The header jib clamp 78 has an arm 82 that will enter through the center of the header 24 after which the arm 82 is retracted by cylinder 84 to grip the header 24. The jib 80 is then swung away from the pipe 10 as shown in FIG. 5 and the header 24 is deposited in the header cleaning station 46.

Figure 7:
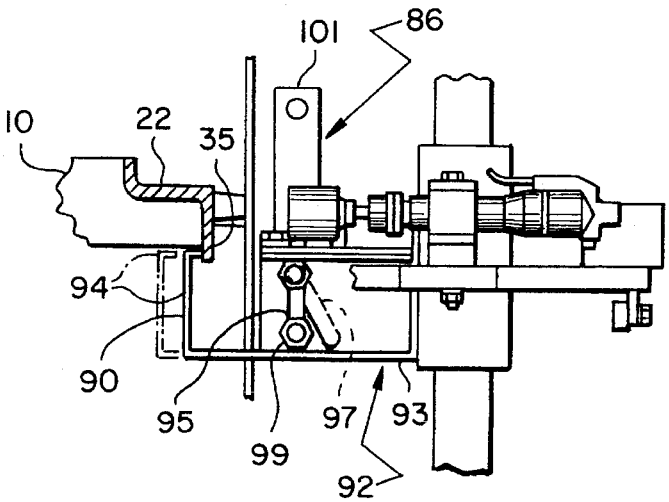
FIG. 7 is an enlarged side elevational view of the pallet ring gripping mechanism.

For removing the pallet 22 from the pipe 10, there is positioned near the pallet end of the pipe 10 a pallet gripper 86. Pallet gripper 86 is shown in more detail in FIGS. 7 and 8 and operates in a manner very similar to the header gripper 66 in that it is advanced and retracted by a hydraulic cylinder 88 so that the legs 90 of the pallet puller 92 can be positioned around the outer edge of the pallet 22. The bottom flange 35 of the pallet 22 extends just beyond the outer surface of the pipe 10, and the hook 94 on each of the legs 90 of the puller 92 are moved inwardly so as to grip behind the outer edge 36 of the pallet 22, as best seen in FIG. 7. When the pallet 22 has thus been hooked, cylinder 88 is actuated to apply a pulling force on the puller 92 after which an air hammer 96 will gently tap the pallet 22 while cylinder 88 continues to apply force to the puller 92 until the pallet 22 is pulled free from the pipe 10.

Figure 8:
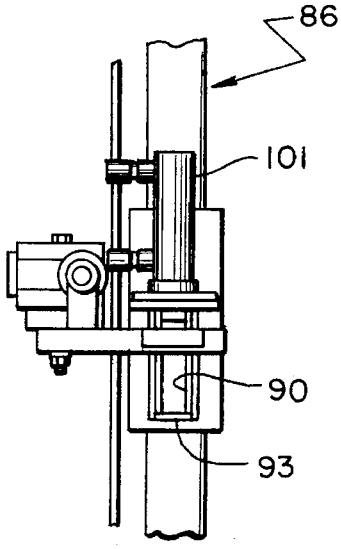
FIG. 8 is an end view of the gripping mechanism of FIG. 7.

It will be understood that preferably the header gripper 66 and the pallet gripper 88 are operated simultaneously, and that the amount of force exerted is approximately twice the weight of the pipe. This amount of force requires less tapping by the air hammers 76 and 96. Also, in FIG. 5 there are shown in the dotted lines at the bottom ends of the pipe 10, a portion of the leg 70 of the header gripper 66 and a portion of the leg 90 of the pallet gripper 86 each in the gripping position. Also, FIGS. 7 and 8 illustrate the means by which the grippers 66 and 86 are positioned and locked in a gripping position even if the pallet or header ring is cocked slightly on the pipe 10. FIGS. 7 and 8 show this equalizing means in connection with the pallet gripper 86, but it will be understood that the same type of arrangement is used in connection with the header gripper 66. The leg 90 is telescoped in a sleeve 93 which contains a slot 95 extending transversely through it. The leg 90 also has a slot 97 that extends at an angle to the slot 95. A pin 99 extends through the slots 95 and 97, and pin 99 is movable in the slots by hydraulic cylinder 101. Because the slots 95 and 97 are at an angle to each other, movement of the pin 99 will move the leg 90 in and out of the sleeve 93 and thus advance or retract the hook 94. Therefore, as the pallet gripper 86 is advanced into a gripping position, the cylinder 101 for each head 90 containing a hook 94 will be actuated to advance the hook 94. When the pallet gripper has been advanced to its gripping position, the cylinder 101 will be reversed to pull each hook 94 into engagement with the flange 35 of the pallet 22 at which time each cylinder 101 will be locked to lock the hook 94 onto the flange 35. Thus, if the pallet is slightly cocked, each gripper hook 94 will automatically be engaged with the flange 35 so that when the pallet gripper 86 is retracted, equal force will be applied to each of the gripper hooks 94 to prevent the pallet 22, if cocked, from jamming on the pipe 10.

Also, as illustrated in FIG. 5, a pallet jib 98 is provided with a jib clamp 100 that has an arm 102 for gripping the removed pallet 22 and transferring it into the pallet cleaning station 48.

It will be understood that by use of three legs on the pallet gripper 86 and three legs on the header gripper 66, and with the equalizing mechanism shown in FIGS. 7 and 8, that the rings will be pulled with equal force from three points thus preventing any cocking of the ring as it is pulled free from the pipe 10. If the header gripper 66 and pallet gripper 86 do not pull uniformly, the ring being pulled can become cocked and lock up on the end of the pipe. Also, each leg 70 of the header gripper 66 and each leg 90 of the pallet gripper 86 is independent, and thus even if the ring to be removed is slightly cocked before it is pulled, the pullers will be effective to remove the ring by action of the equalizing mechanism.

After the header jib 80 moves the header 24 to the header cleaning station 46 or the pallet jib 98 moves a pallet 22 to the pallet cleaning station 48, the ring to be cleaned is deposited on the receiving table 104 (FIG. 9). Because the headers 24 and pallets 22 differ in size and shape for the same pipe, and because the diameter of either a header 24 or pallet 22 varies depending upon the diameter of the pipe, the method and system of the invention provides a means for moving the rings, regardless of size, from the cleaning table 104 into the cleaning station 106. In FIG. 9, and in the remaining figures and in the description hereinafter, the receiving table, cleaning station and the method and system for cleaning the rings will be described in detail for both the pallet and header in which there are used pulverizers, vibrating chisels and brushes to clean the rings. However, it will be understood that not all of these devices need be used for any particular pallet or header, and the use of them will depend upon the particular ring being cleaned. FIG. 9 illustrates schematically how a ring to be cleaned is moved from the receiving table 104 into the cleaning station 106, which might be either the header cleaning station 46 or the pallet cleaning station 48. Regardless of the size of the ring to be cleaned, when it is deposited on the receiving table 104, it will be deposited so that point "A" is inside the ring as shown in FIG. 9 which shows the smallest of rings as well as the largest. At point "A", the arm 108 of what we have termed a "shark fin" will be released to pivotly swing upwardly through a slot 110 that extends through the cleaning table 104 from point "A" to point "B" in the table of the cleaning station 106. This is illustrated in FIG. 9. In FIG. 15, there is schematically shown what occurs. The arm 108 of the shark fin is pivotly mounted on pivot 112, and as it returns from point "B" to point "A", it will be in a retracted position held there by the locking pin 114. When the shark fin reaches the end of its return in slot 110 at point "A", it will strike an actuator 116 which will release the shark fin from the locking pin 114 and cam the arm 108 on pivot 112 into an upward position where it will extend through the slot 110 of the table 104. At this time, the arm 108 of the shark fin extends up through the slot 110 inside of the pallet 22. Rotation of the shark fin is limited by the pin 114. When the arm 108 is in its fully upright position, direction of the travel of the shark fin is reversed, and it will be moved along in the slot 110 from point "A" to point "B" as shown in FIG. 9. The sequence of this operation is illustrated schematically in the six steps shown in FIG. 15. As shown in the sixth step, the shark fin has started its travel toward point "B" and has engaged the inside edge 38 of the pallet 22 and will then start to pull the pallet 22 into the cleaning station 106. At point "B", the shark fin will stop, reverse its direction, and be cammed downwardly through the slot 110 to a position beneath the table 104 when it strikes a gate 109, thus leaving the pallet 22 at point "B". Obviously, when pulling a pallet 22 toward point "B" as shown in the sixth step of FIG. 15, the gate 109 will open to allow the fin to pass and remain in the upright position, engaged with pallet 22.

FIG. 9 illustrates a variety of sizes of rings inside of the cleaning station 106. Regardless of the size, all of these rings will be positioned by the shark fin with point "B" located inside of the ring. At this time, if desired, a protective hood (not shown) can be lowered to over and around the cleaning station 106 to provide an enclosed and sealed chamber for confining and controlling particles of debris, dust and fumes created during cleaning of the rings inside the chamber.

Figure 19:
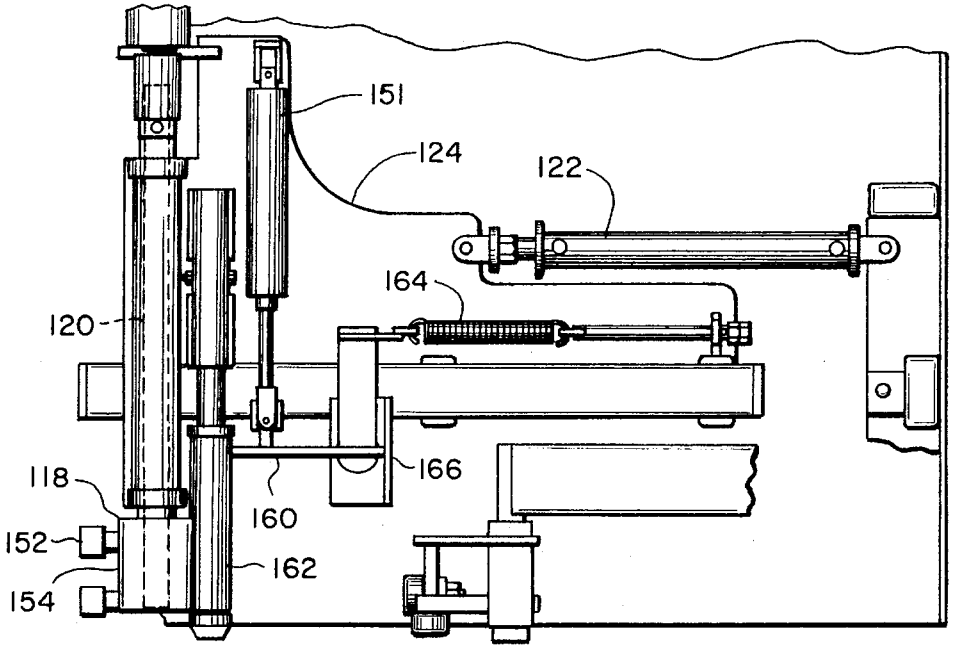
FIG. 19 is a side elevational view of the vibrating chisel for cleaning an inner edge of a pallet ring.

Once a ring to be cleaned has been moved into the cleaning station 106 as described, a roller 118 (see FIG. 19) mounted at the lower end of a shaft 120 on the supporting framework 124 is rotatably driven by a hydraulic motor (not shown) and is dropped downwardly to a position inside of the ring at the point "B". The roller 118 engages the ring and then continues its movement outwardly under power of the hydraulic cylinder 122. The ring is thus moved outwardly until it engages a pair of rollers 126 that are mounted on fixed vertical axes near one side of the cleaning chamber. The rollers 118 and 126 will cause the ring to be cleaned to rotate. Also, the pressure applied to the ring by the rollers 118 and 126 is sufficiently high that it will pulverize any concrete residue along the outer edge of the bottom flange 35 and the inner edge 38 of the upper flange 37 of the pallet 22. However, this pulverizing action is not sufficient to completely remove all of the hardened concrete residue on all the surfaces of the pallet 22. Therefore, in addition, the method and system of the invention utilize two vibrating chisels and three brushes to thoroughly clean all of the critical surfaces of the pallet 22. The number of brushes and chisels used will depend upon the particular ring being cleaned. For example, a header 24 will require a different arrangement of vibrating chisels and brushes than those necessary to properly clean a pallet. In the preferred embodiment shown in the drawings for a pallet cleaner, there are three brushes and two vibrating chisels illustrated. It should be understood however that not all of these may be utilized in a particular apparatus designed for a different type of ring from that illustrated.

Referring to FIG. 10, a first brush 128 is shown mounted for rotation about a vertical shaft that is connected to a pulley 130 that is driven by a belt 132 from the drive pulley of a electric motor 134. The brush 128 is a face brush and is mounted on an arm 136 that is swingable about a vertical shaft 138. The function of the brush 128 is to clean the outside surface 43 of the vertical flange 33 of the pallet 22.

Mounted opposite the first brush 128 is a second brush 140 which also rotates about a vertical shaft driven by pulley 142 that is connected by belt 144 to electric motor 146. Brush 140 is a cup brush and is mounted on arm 143 the opposite end of which is mounted on pivot shaft 145. The function of the brush 140 is to clean the top surface 36 of the bottom flange 35 of the pallet 22. Both brushes 128 and 140 are mounted on a supporting structure that is lowered and raised under action of the cylinders 148.

A third brush 150 (see FIG. 10) is rotatable about a horizontal axis, and brush 150 is positioned between the rollers 126. The brush 150 functions to clean the top surface 40 of the upper flange 37 of the pallet 22.

The pallet and header rings used in concrete pipe-making are precisely sized rings, and it is undesirable to remove any metal from the rings during the cleaning process. The brushes 128, 140 and 150 will remove most of the material without damaging the ring, but it is frequently difficult to completely remove the concrete residue along the bottom surface 41 of the upper flange 37 and the bottom surface of the bottom flange 35 of the pallet 22. In these instances, the method and the system of the invention provides vibrating chisels to clean these surfaces.

As best seen in FIGS. 16–21, a vibrating chisel assembly 149 is utilized to clean the bottom surface 41 of the upper flange 37 of the pallet 22. The vibrating chisel assembly 149 has a blade 152 mounted on a holder 154 that is pivotly mounted on a shaft 156 secured to an arm 158 which in turn is pivotly secured to a supporting structure 160 about a pivot shaft 162. Cylinder 151 (FIG. 19) moves blade 152 into cutting position and applies sufficient pressure to the blade 152 to remove the concrete deposits on surface 41. The blade 152 is biased against the concrete deposit to be removed on surface 41 by action of springs 164 which are connected to the supporting structure 160. Therefore, because the blade 154 is pivotly mounted about a horizontal pivot shaft 156, and the entire structure is pivotly mounted about the vertical pivot shaft 162, if the blade 152 engages a concrete deposit that is particularly difficult, the tool will either tilt or pivot allowing the blade 152 to bypass the concrete deposit with the springs 164 returning the blade 152 back into contact with the bottom surface 41. This is accomplished without damage to the pallet ring. To assist in breaking up the concrete deposits, the blade 152 and its holder 154 are vibrated by vibrator 166 also mounted on the arm 158 (see FIGS. 20 and 21). With the vibrations reciprocating the blade 152 at a rate of approximately 3,000 vibrations per minute, this will produce the chiseling action without damage to the ring.

Figure 16:
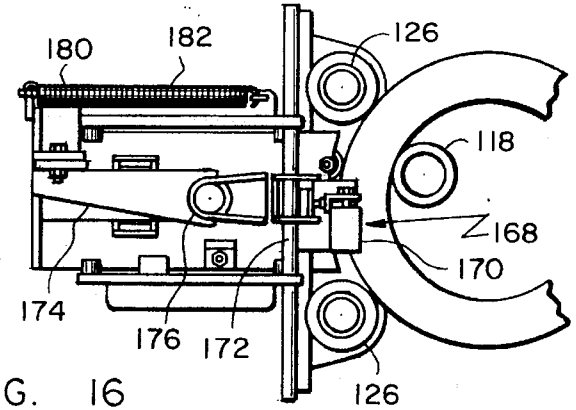
FIG. 16 is a top or plan view of the vibrating chisel for the outer edge of a pallet ring.
Figure 17:
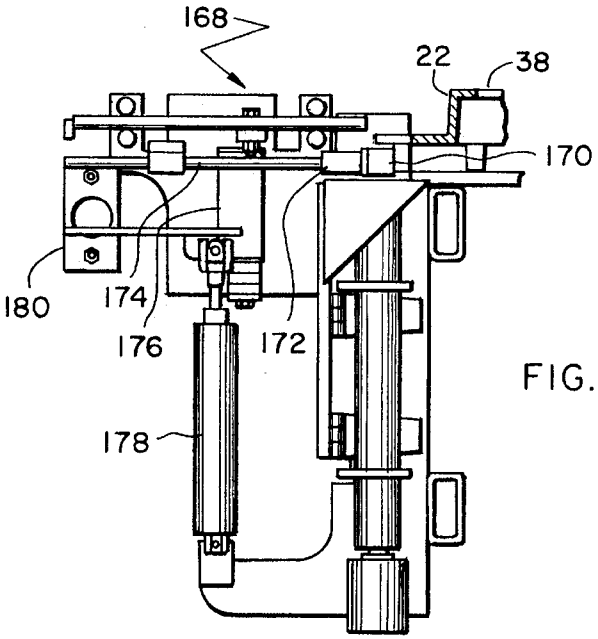
FIG. 17 is a side elevational view of the vibrating chisel of FIG. 16.

In order to clean the bottom surface of the bottom flange 35 of a pallet 22, the pallet cleaning station 106 can also be provided with a second vibrating chisel assembly indicated generally by the reference numeral 168 (see FIGS. 16 and 17). The cutter assembly 168 includes a cutter blade 170 mounted for pivotal movement about a horizontal pivot rod 172 that in turn is mounted on a support arm 174 that is pivotly mounted on vertical pivot rod 176. The entire assembly is moveable upwardly and downwardly into proper position under power of a pneumatic cylinder 178, which cylinder 178 applies sufficient, proper contact pressure to produce the chiseling action. The chisel assembly 168 is vibrated at a relatively high frequency (3,000 vibrations per minute) by vibrator 180 to produce a chiseling action similar to the vibrating chisel assembly for the bottom surface 41 of the upper flange 37. Springs 182 bias the arm 174 about the vertical pivot rod 176 and thus maintain the cutter in contact with the bottom surface of the bottom flange 35 while permitting the cutter blade 170 to ride up and over a deposit without damage to the pallet ring.

Figures 15A, 15B, 15C, 15D, 15E, 15F, 18, 20, 21:
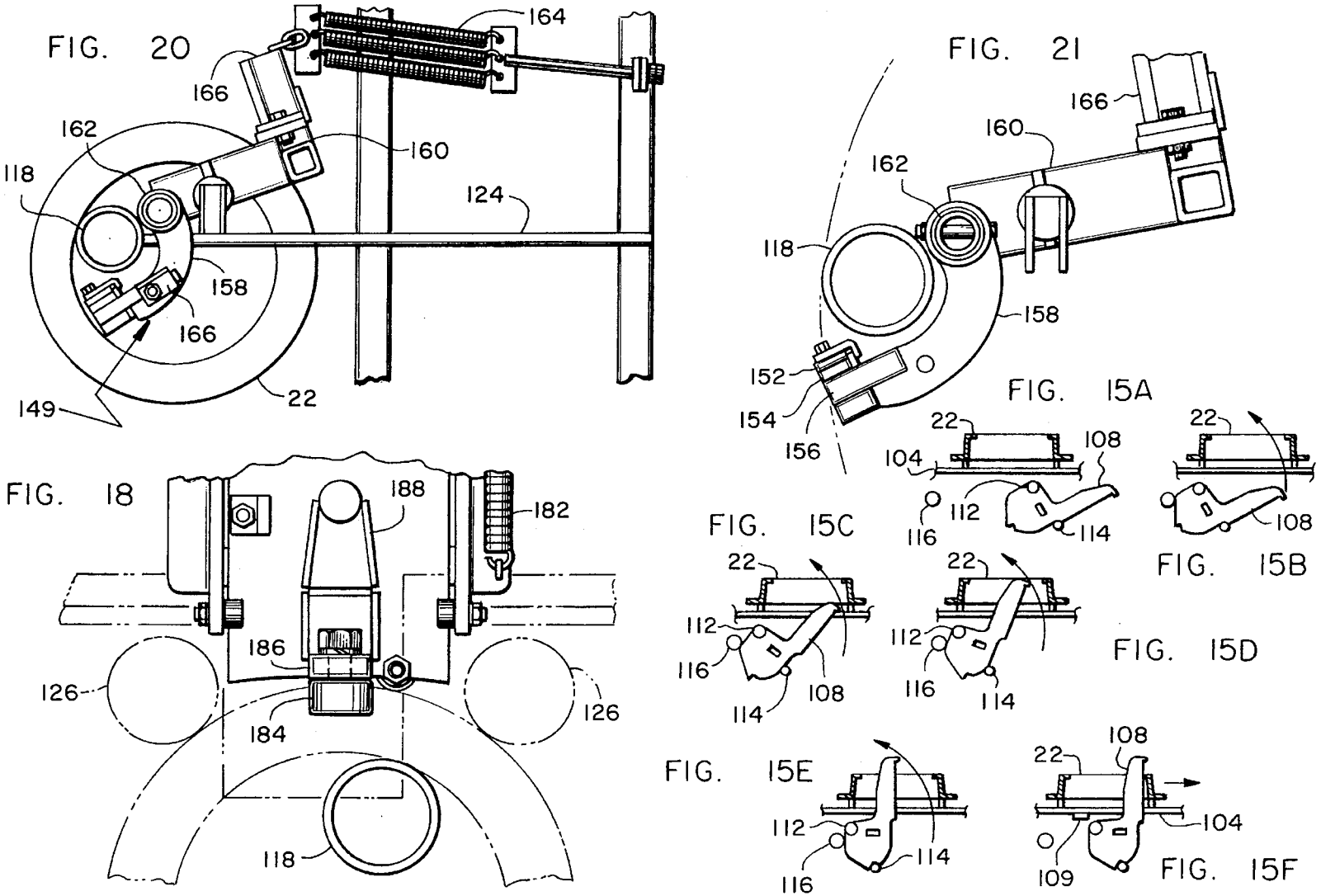
FIG. 18 is a top or plan view illustrating how the pallet ring is held down while the vibrating chisel pushes up.
FIG. 20 is a top or plan view of the inner edge chisel of FIG. 19.
FIG. 21 is an enlarged view of a portion of the inner edge chisel of FIGS. 19 and 20.

Because the outer edge chisel assembly 168 will tend to tip the ring unless it is held down, a hold-down roller 184 is mounted for rotation about a horizontal shaft 186 which is secured to a supporting structure 188, all as best seen in FIG. 18.

Figure 11:
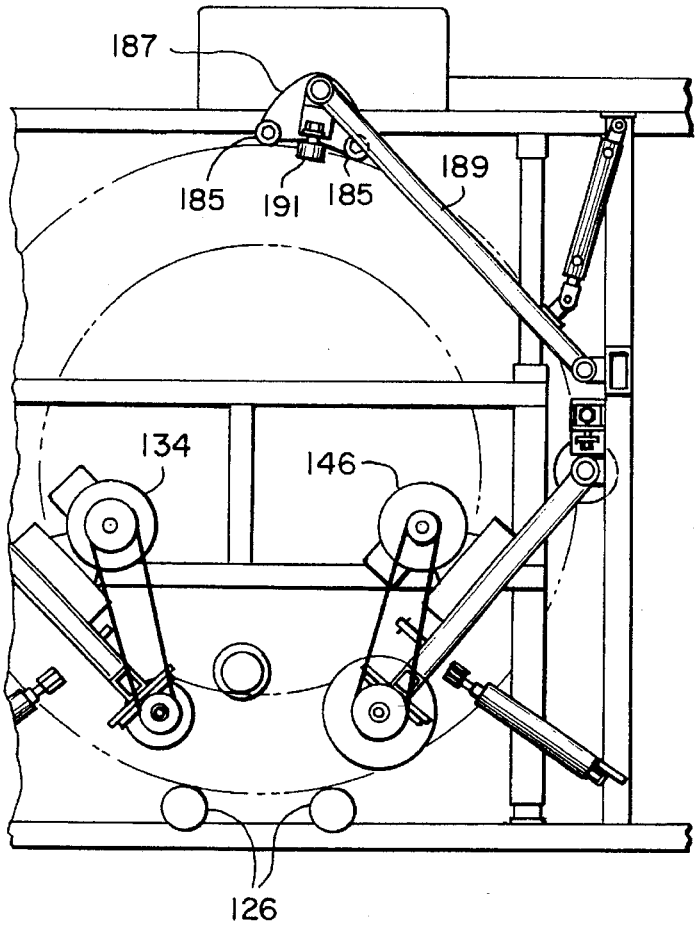
FIG. 11 is a plan view similar to FIG. 10 but showing portions of the cleaning mechanism removed to illustrate more clearly the ring hold-down rollers at the rear of the cleaning station.

Also, because the force exerted by the pulverizing rollers 126 on the outer edge of the bottom flange 35 of the pallet 22 combined with the force exerted by the roller 118 on the inner edge 38 of the upper flange 37 tend to lift the pallet 22, FIG. 11 illustrates a hold down means for the side of the pallet 22 opposite the rollers 126. FIG. 11 is a top or plan view of a typical pallet cleaning station 106 similar to the view shown in FIG. 10 but with a number of the components removed to show the hold down assembly. A pair of spaced-apart guide rollers 185 are mounted on vertical axes on a supporting plate 187 that is pivotly mounted on the end of an swingable arm 189. Rollers 185 will be moved by arm 189 against the outside edge of the bottom flange 35 of the pallet 22, and supporting plate 187 also supports a hold-down roller 191 that is mounted on a horizontal axis between the guide rollers 185. Hold-down roller 191 engages the top surface 36 of the bottom flange 35 and therefore resists any lifting force created by the pulverizing rollers 126 and 118.

The foregoing description is for a cleaning station 106 in which a pallet 22 is cleaned. However, a header 24 is used for the spigot forming end of a pipe, the header 24 is of a different configuration and the critical surfaces to be cleaned are different than those on a pallet 22. The principles of pulverizing, chiseling and brushing are also used in cleaning a header 24, and the basic cleaning apparatus is similar in many respects to that just described for the cleaning of a pallet 22. However, we have shown in FIGS. 12, 13 and 14 some of the major differences in the structure of the cleaning apparatus for a header 24. In these figures, where components similar to those of the pallet cleaner are shown, we have used the same reference numerals but followed by the letter "a". Once a header 24 to be cleaned has been moved into the cleaning station **106*a* as previously described for the pallets, a roller 118*a* is dropped downwardly to a position inside of the header 24. The roller 118*a* engages the header 24 and then continues its movement outwardly under power of the hydraulic cylinder 122*a*. The header 24 is thus moved outwardly until it engages a pair of rollers 126*a* near one side of the cleaning chamber. The rollers 118*a* and 126*a* will cause the header 24 to rotate. Also, the pressure applied to the header by the rollers 118*a* and 126*a* is sufficiently high that it will pulverize any concrete residue along the inner edge 28 of the bottom flange 27 and the outer edge 26 of the upper flange 25 of the header 24. However, this pulverizing action is not sufficient to completely remove all of the hardened concrete residue on all the critical surfaces of the header 24. Therefore, in addition, the method and system of the invention utilize a vibrating chisel and three brushes to thoroughly clean all of the critical surfaces of a header 24. Of, course, the number and arrangement of the brushes used and the position of the chisel will depend upon the particular ring being cleaned. In the preferred embodiment shown in FIGS. 12–14** for a header cleaner, there are three brushes and a single vibrating chisel illustrated. It should be understood however that not all of these may be utilized in a particular apparatus designed for a different type of header ring from that illustrated.

Figure 12:
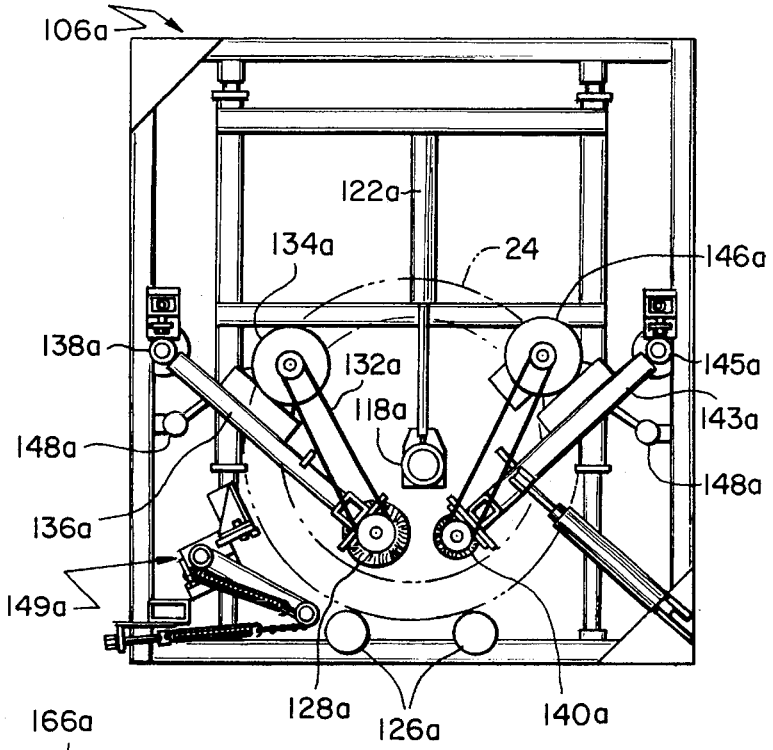
FIG. 12 is a top or plan view of the cleaning station for header rings and illustrating the ring positioning mechanism and the vibrating chisel and brushes necessary for cleaning header rings rather than pallet rings.

Referring to FIG. 12, a first brush **128*a* is shown mounted for rotation about a vertical shaft that is connected to a pulley driven by a belt 132*a* from the drive pulley of a electric motor 134*a*. The brush 128*a* is mounted on an arm 136*a* that is swingable about a vertical shaft 138*a*. The function of the brush 128*a* is to clean the inside surface 31 of the header 24**.

Mounted opposite the first brush **128*a* is a second brush 140*a* which also rotates about a vertical shaft driven by an electric motor 146*a*. Brush 140*a* is a cup brush and is mounted on arm 143*a* the opposite end of which is mounted on pivot shaft 145*a*. The function of the brush 140*a* is to clean the inner surface 32 of the bottom flange 27. Both brushes 128*a* and 140*a* are mounted on a supporting structure that is lowered and raised under action of the cylinders 148**.

Similar to the pallet cleaner, there is also a third brush (not shown) that is similar in position and operation to the brush 150 of the pallet cleaner. Like the brush 150, this brush is positioned between the rollers **126*a*, and it and functions to clean the top surface 30 of the upper flange 25**.

Figure 13:
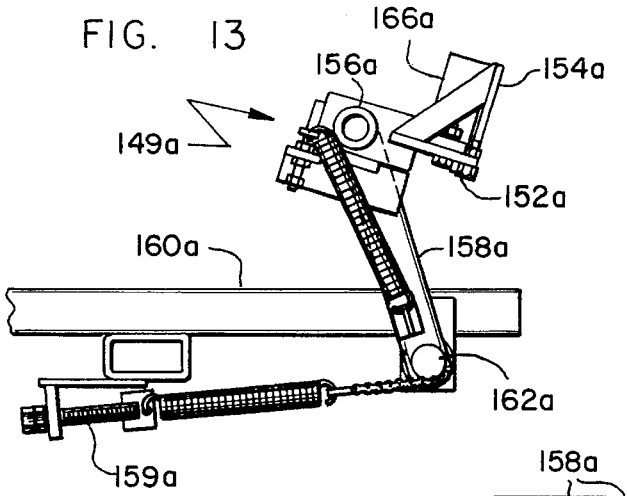
FIG. 13 is an enlarged plan view of the vibrating chisel mechanism shown in FIG. 12.
Figure 14:
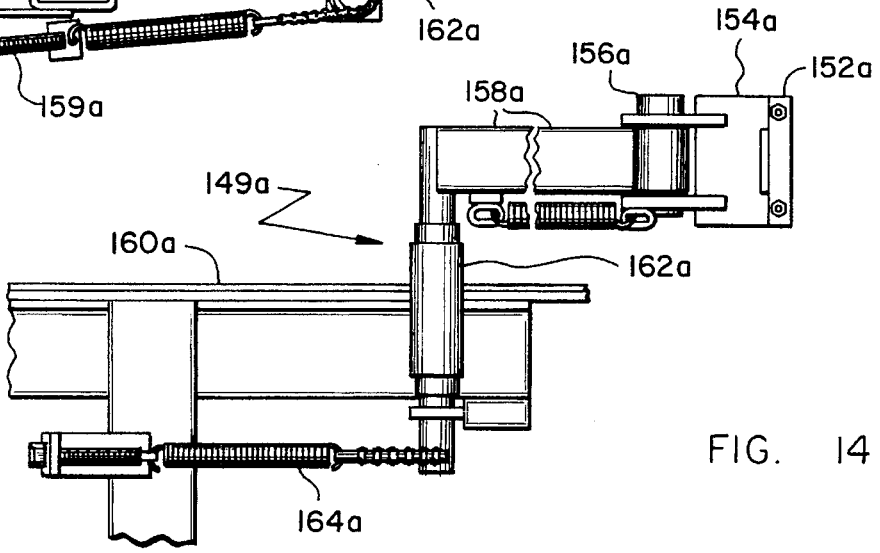
FIG. 14 is an enlarged elevational view of the vibrating chisel mechanism shown in FIG. 13.

As best seen in FIGS. 13 and 14, a vibrating chisel assembly **149*a* is also utilized to clean the outer edge 26 of the upper flange 25 of the header 24. The vibrating chisel assembly 149*a* has a blade 152*a* mounted on a holder 154*a* that is pivotly mounted on a shaft 156*a* secured to an arm 158*a* which in turn is pivotly secured to a supporting structure 160*a* about a pivot shaft 162*a*. The blade 152*a* is biased against the concrete deposit to be removed on outer edge 26 by action of spring 164*a* which is connected at one end to the arm 158*a* and at the other end to an adjuster 159*a*. Therefore, because the blade 152*a* is pivotly mounted about a pivot shaft 156*a*, and the entire structure is pivotly mounted about the vertical pivot shaft 162*a*, if the blade 152*a* engages a concrete deposit that is particularly difficult, the tool will pivot allowing the blade 152*a* to bypass the concrete deposit with the spring 164*a* returning the blade 152*a* back into contact with the outer edge 26. This is accomplished without damage to the header ring. To assist in breaking up the concrete deposits, the blade 152*a* and its holder 154*a* are vibrated by vibrator 166*a*. With the vibrations reciprocating the blade 152*a* at a rate of approximately 3,000 vibrations per minute, this will produce the chiseling action to remove the concrete deposits from outer edge 26** without damage to the header ring.

The ideal is to perform all of the cleaning functions on a single ring in approximately 20 to 30 seconds. With the foregoing described system, this can be accomplished, and all critical surfaces of the ring properly and completely cleaned to maintain the preciseness of the ring. Usually, cleaning can be accomplished in a single complete revolution of a ring, and the timing can be controlled by suitable sensors (not shown) which sense the lugs on the ring and count the number necessary for a complete rotation. If a ring has no lugs, other components can be sensed or the revolution can be controlled by a timer. When a complete cleaning cycle has occurred, it is necessary then to remove the now cleaned ring from the cleaning station 106. Referring now to FIG. 9, the line 190 represents a slot for a second shark fin that will be actuated to rise in the slot 190 inside of the ring at approximately point "C". The shark fin will then move the now cleaned ring into an oiling station 190. At this station, the rings can be passed through an oil bath or a spray booth, for example, or the rings can be sprayed from controlled spray nozzles (not shown) strategically positioned in the oiling station 190 so as to strike all surfaces of the ring with an oil mist. Any suitable oiling means can be utilized, but over oiling and over spray should be controlled for both economic and environmental reasons. Once oiled, the rings can then be removed and stacked or moved to a storage area.

From the foregoing description of the construction and operation of the ring removal and cleaning systems and methods of the invention, it will be evident that specific design changes can be made to accommodate the principles of the invention for the particular type of pallet or header rings being removed and cleaned. However, the principles of the invention of properly orienting the pipe, pulling the header and pallet simultaneously by pullers from opposite ends of the pipe while tapping the rings after pressure is applied to facilitate removal, can be applied to headers and pallets of any known design. It is within the knowledge and skill of persons skilled in the art to make such design changes. Moreover, depending again upon the specific design and type of pallets or headers that are to be cleaned, the particular arrangement and number of the vibrating chisel and brushes may vary from that disclosed in the preferred embodiments described herein. However, the shark fin system for moving the pallet rings automatically, as well as the principles of removing the concrete residues using a combination of pulverization, chiseling and brushing, with the vibration chiseling tools being pivotly mounted so as to release in the event extremely hard material is encountered, can be utilized and applied to any known situation.

Having thus described the invention in connection with preferred embodiments thereof, it will be evident to those skilled in the art that various revisions and modifications can be made to the preferred embodiments described herein without departing from the spirit and scope of the invention. It is our intention, however, that all such revisions and modifications that are obvious to those skilled in the art will be included within the scope of the following claims.

What is claimed is as follows:

1. A system for cleaning concrete deposits from the surfaces of annular shaped headers and pallet rings used in the manufacture of concrete pipe, said system comprising: a cleaning table having a receiving area into which the ring to be cleaned is moved; a cleaning station extending over a portion of the cleaning table; a pair of spaced-apart drive rollers at one side of the table within the cleaning station; a first slot in the cleaning table extending from the receiving area through the cleaning station; a first ring moving member moveable along the first slot and controllably extendable up through the first slot and above the table and retractable beneath the table; first means causing the ring moving member to extend up through the table at the ring receiving area so as to extend inside a ring resting on the table at the receiving area; second means to move the ring moving member along the first slot and advance a ring from the receiving area into the cleaning station adjacent to the drive rollers within the station; third means to retract the ring moving member when the ring is adjacent the drive rollers; fourth means to move the ring and hold it against the drive rollers to allow the drive rollers to rotate the ring; cleaning means moveable into and out of a position to engage the surfaces of the ring to be cleaned while the ring is rotating; a second slot in the cleaning table extending from the cleaning station to an area outside the cleaning station; and a second ring moving member moveable along the second slot and controllably extendable up through the slot and retractable beneath the table to selectively engage a cleaned ring and move it outside the cleaning station.

2. The system of claim 1 in which the drive rollers and fourth means apply pressure to the surfaces of the ring engaged by the rollers and the fourth means, which pressure is sufficient to pulverize concrete deposits on those surfaces so engaged.

3. The system of claim 2 in which the cleaning means includes a rotating brush and a vibrating chisel that engage the surfaces of the ring to be cleaned.

4. The system of claim 3 in which the vibrating chisel is biased against the surface to be cleaned so as to prevent any damage to the surfaces of the ring being cleaned by the chisel.

5. The system of claim 3 in which the cleaning means includes a plurality of brushes, one for each surface to be cleaned.

6. The system of claim 1 in which the fourth means that moves the ring and holds against the drive rollers is a roller moveable into and out of engagement with the inside of the ring.

* * * * *